US008528162B2

(12) United States Patent
Tang et al.

(10) Patent No.: US 8,528,162 B2
(45) Date of Patent: Sep. 10, 2013

(54) DUST COLLECTION CONTAINER AND VACUUM CLEANER HAVING THE SAME

(75) Inventors: Ya-Lun Tang, Taoyuan County (TW); Li-Lu Chen, Taipei (TW); Hsin-Yi Pai, New Taipei (TW)

(73) Assignee: MSI Computer (Shenzhen) Co., Ltd., Shenzhen, Guangdong Province (CN)

( * ) Notice: Subject to any disclaimer, the term of this patent is extended or adjusted under 35 U.S.C. 154(b) by 260 days.

(21) Appl. No.: 13/085,541

(22) Filed: Apr. 13, 2011

(65) Prior Publication Data

US 2012/0151709 A1 Jun. 21, 2012

(30) Foreign Application Priority Data

Dec. 20, 2010 (TW) ..... 99224648 U

(51) Int. Cl.
*A47L 9/10* (2006.01)

(52) U.S. Cl.
USPC ..... 15/347

(58) Field of Classification Search
USPC ..... 15/346, 347, 319, 340.1, 340.3
See application file for complete search history.

(56) References Cited

U.S. PATENT DOCUMENTS

| | | | | |
|---|---|---|---|---|
| 7,059,012 | B2 * | 6/2006 | Song et al. | 15/340.3 |
| 2004/0098957 | A1 * | 5/2004 | Yoo et al. | 55/410 |
| 2010/0313912 | A1 * | 12/2010 | Han et al. | 134/21 |

FOREIGN PATENT DOCUMENTS

TW M279323 U 11/2005

* cited by examiner

*Primary Examiner* — Robert Scruggs
(74) *Attorney, Agent, or Firm* — Morris Manning & Martin LLP; Tim Tingkang Xia, Esq.

(57) ABSTRACT

A dust collection container, capable of being installed in a vacuum cleaner, includes a case body and a blocking member. The blocking member is disposed in the case body to separate the case body into a dust chamber and a diversion chamber, a suction inlet corresponding to the dust chamber and an exhaust opening corresponding to the diversion chamber are disposed in the case body, and a barrier piece is disposed at the blocking member opposite to the suction inlet, so as to form a slow flow area between the barrier piece and the suction inlet to effectively disperse dirt.

10 Claims, 8 Drawing Sheets

DUST COLLECTION CONTAINER AND VACUUM CLEANER HAVING THE SAME

CROSS-REFERENCE TO RELATED APPLICATIONS

This non-provisional application claims priority under 35 U.S.C. §119(a) on Patent Application No. 099224648 filed in Taiwan, R.O.C. on Dec. 20, 2010, the entire contents of which are hereby incorporated by reference.

BACKGROUND OF THE INVENTION

1. Field of the Invention

The present invention relates to a container, and more particularly to a dust collection container used to store dirt in a mobile sweeper.

2. Related Art

In order to keep cleanliness and sanitation of indoor environment, people regularly arrange and clean the house, in which generally the most commonly used utensils for cleaning dirt are, for example, rags, mops, and vacuum cleaners. Generally, the vacuum cleaner is the best weapon against the dirt. The vacuum cleaner mainly has a vacuum pump (an air-extracting fan configured with a motor), a filter screen, a dust collection box, a guiding tube, and a suction head. The cleaning principle is that mainly through rotation of the air-extracting fan, a negative pressure state is formed inside the vacuum cleaner, so as to produce an inward suction, thereby sucking away the dirt attached to the surface of the floor, the carpet, the wall, the furniture, or other surfaces being not easily cleaned by directly using the rags or brooms, and further effectively avoiding a situation that the dirt flies around when the dirt on the floor is swept by using the broom.

The vacuum cleaner has the above advantages, but the filter screen and the dust collection portion need to be regularly cleaned to keep an interior air channel of the vacuum cleaner unobstructed, so as to maintain enough internal pressure and inward suction formed inside the vacuum cleaner. However, in recent years, in order to save manpower, the vacuum cleaner is combined with a self-propelled device to become a robot vacuum cleaner.

Moreover, since the gas usually flows through the shortest path during flowing, the gas is sucked to the dust collection box from a suction inlet, and is exhausted out of the vacuum cleaner after flowing through the filter screen. For example, when the dirt is sucked from the suction inlet, as the gas flows through the shortest path, the dirt is attached to the filter screen at the suction inlet when the gas passes through the filter screen at the suction inlet. As time goes by, the suction inlet of the entire dust collection box is increasingly filled up with the dirt, such that the dirt is collected at the suction inlet, so the suction inlet is blocked and other spaces cannot be effectively used. Therefore, how to effectively use remaining spaces of the filter screen and the dust collection box, and delay the time for cleaning the filter screen of the vacuum cleaner is a big problem to be solved by designers.

SUMMARY OF THE INVENTION

In view of the above problem, the present invention is a vacuum cleaner and a dust collection container, so as to solve a problem existed in the prior art that dirt is collected at a suction inlet, so the suction inlet is blocked and other spaces can not be effectively used.

The present invention provides a dust collection container, which is capable of being installed in a vacuum cleaner, and comprises a case body and a blocking member. The blocking member is disposed in the case body, so as to separate the case body into a dust chamber and a diversion chamber. A suction inlet corresponding to the dust chamber and an exhaust opening corresponding to the diversion chamber are disposed in the case body. A barrier piece is disposed at the blocking member opposite to the suction inlet.

The present invention provides a vacuum cleaner, which comprises a dust collection container and an air-extracting device. The dust collection container comprises a case body and a blocking member, in which the blocking member is disposed in the case body to separate the case body into a dust chamber and a diversion chamber. Moreover, a suction inlet corresponding to the dust chamber and an exhaust opening corresponding to the diversion chamber are disposed in the case body. A barrier piece is disposed at the blocking member opposite to the suction inlet. However, the air-extracting device has an air-extracting chamber and a power element, in which the air-extracting chamber is disposed with an air-extracting opening corresponding to the exhaust opening and a gas outlet corresponding to an outside part of the vacuum cleaner. The power element is disposed in the air-extracting chamber, and enables a gas to be sucked from the suction inlet and exhausted from the gas outlet during operation.

In the dust collection container and the vacuum cleaner applying the same according to the present invention, a barrier piece is disposed at a blocking member opposite to a suction inlet, so as to form a slow flow area between the barrier piece and the suction inlet. A gas forms distributaries at the position of the barrier piece, such that when being sucked into a dust chamber, dirt moves towards ambient space of the dust chamber, so as to ensure that the dirt is not blocked at the position of the suction inlet, thereby effectively using spaces of the dust chamber, and delaying the time for cleaning the dust collection container.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

In a dust collection container and a vacuum cleaner applying the same according to the present invention, the vacuum cleaner may be, but is not limited to, a vehicle vacuum cleaner, a household vacuum cleaner, and a robot vacuum cleaner. In the following embodiments of the present invention, the robot vacuum cleaner is used as the embodiment of the present invention. This embodiment is for the purpose of improving an effective operation time of the robot vacuum cleaner.

Figure 1A:
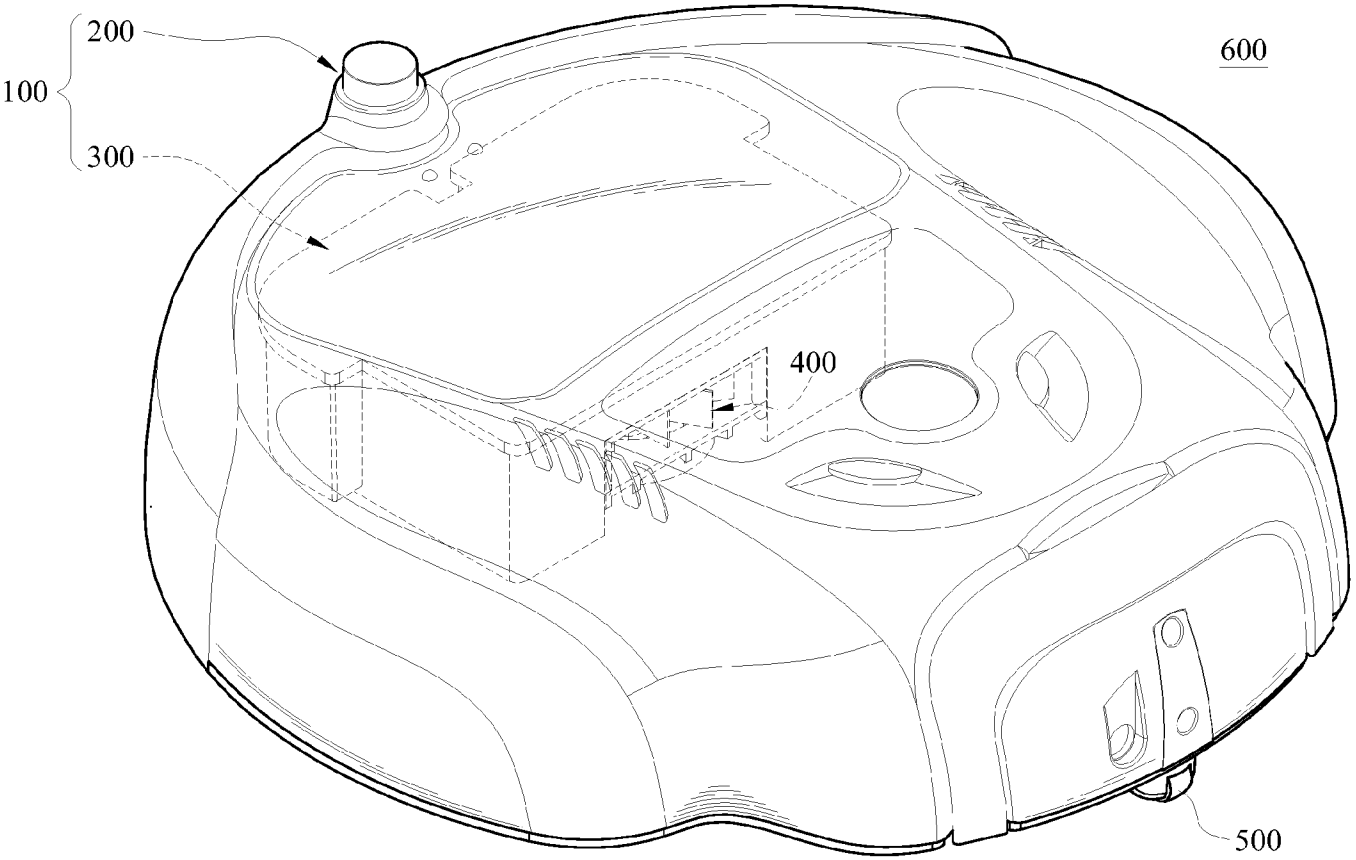
FIG. 1A is a schematic three-dimensional view of an embodiment of the present invention.
Figure 1B:
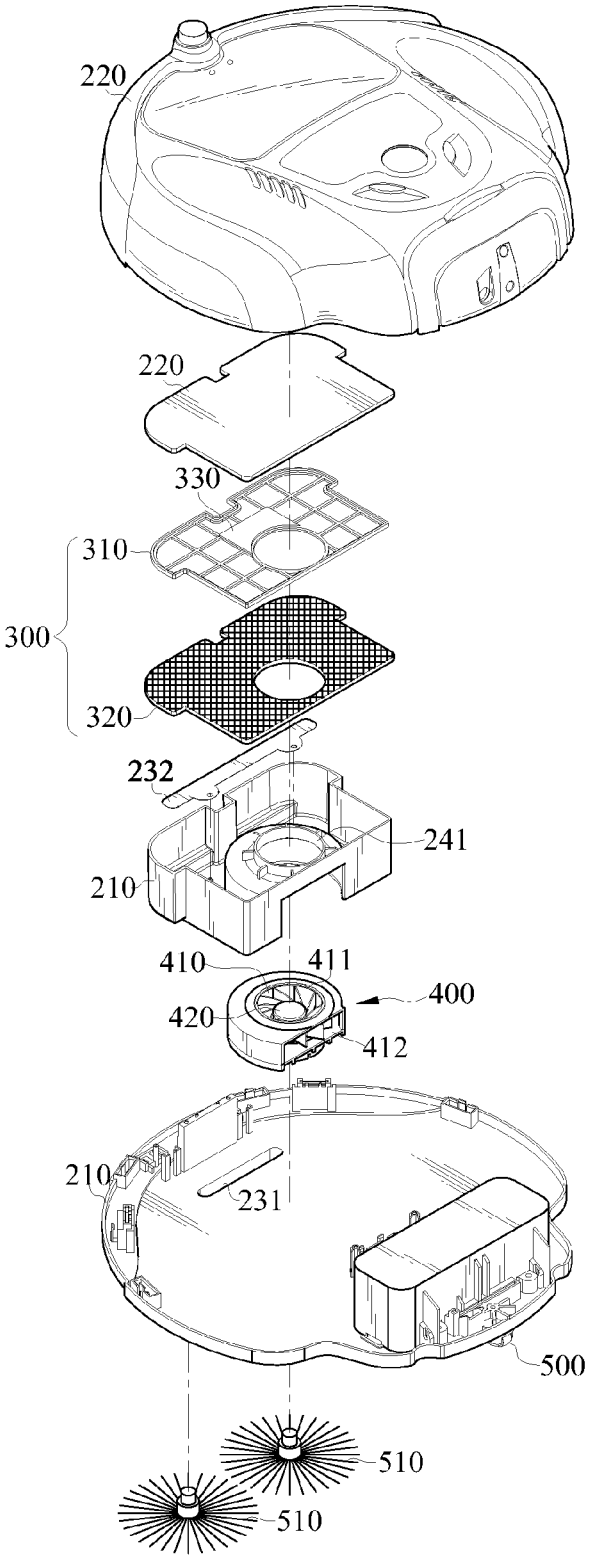
FIG. 1B is a schematic exploded view of FIG. 1A.
Figure 1C:
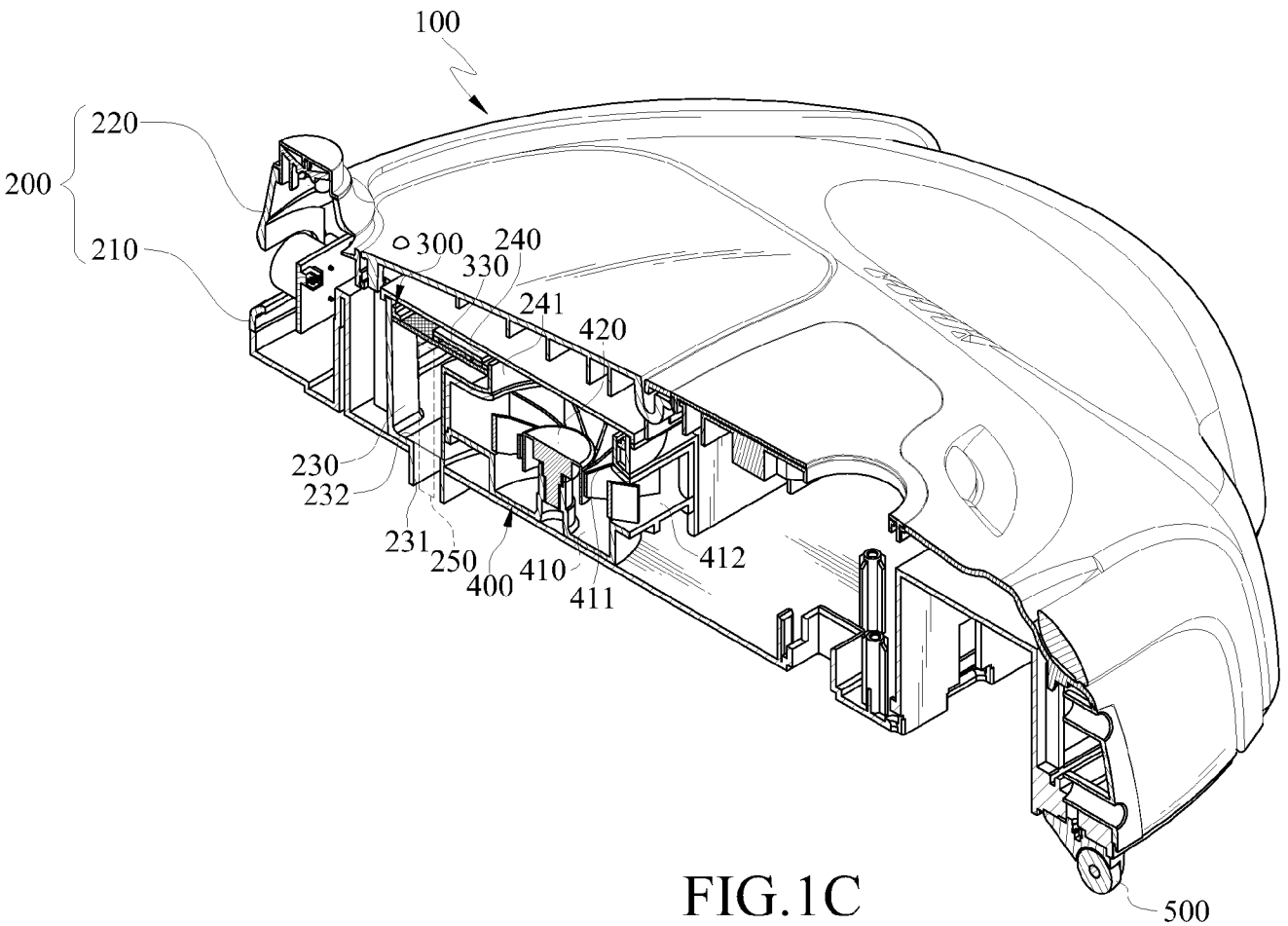
FIG. 1C is a schematic three-dimensional cross-sectional view of a gas channel of FIG. 1A.

FIG. 1A is a schematic three-dimensional view of an embodiment of the present invention, FIG. 1B is a schematic exploded view of FIG. 1A, and FIG. 1C is a schematic three-dimensional cross-sectional view of a gas channel of FIG. 1A. Referring to FIG. 1A, a vacuum cleaner 600 according to the present invention comprises a dust collection container 100 and a air-extracting device 400.

The dust collection container 100 has a function of filtering impurities, for example, dust and hair, and may be applicable to any vacuum cleaner 600, which may be, but is not limited to, the robot vacuum cleaner of this embodiment. The dust collection container 100 comprises a case body 200 and a blocking member 300. The case body 200 has a shell body 210 and a lid body 220, and the lid body is covered on the shell body 210 to form an inner space of the case body 200. However, the blocking member 300 is placed in the inner space of the case body 200, and separates the inner space into a dust chamber 230 and a diversion chamber 240. Moreover, a suction inlet 231 corresponding to the dust chamber 230 and an exhaust opening 241 corresponding to the diversion chamber 240 are disposed in the case body 200. An example is given to illustrate a sequence according to which the gas flows through internal elements of the vacuum cleaner 600, when the gas is sucked into the vacuum cleaner 600. For example, a negative pressure state is formed inside the vacuum cleaner 600, so as to produce an inward suction, thereby sucking away dirt attached to a surface of the floor, the carpet, the wall, the furniture, or other surfaces being not easily cleaned by directly using rags or brooms. When being sucked into the vacuum cleaner 600 from the suction inlet 231, the dirt flows through the dust chamber 230, the blocking member 300, and the diversion chamber 240 in sequence, and then is exhausted out of the case body 200 from the exhaust opening 241. Moreover, a plurality of wheels 500 is disposed at a bottom of the shell body 210, therefore, when the vacuum cleaner 600 slides on the floor, a friction force between the vacuum cleaner 600 and the floor may be reduced, so as to further enhance motility of the vacuum cleaner 600.

Furthermore, the suction inlet 231 further comprises a sealing member 232 being a soft sheet, in which one side edge of the sealing member 232 is fixed on the shell body 210. When the air-extracting device 400 operates, a negative pressure is produced inside the vacuum cleaner 600. The negative pressure results in that the gas is sucked from the suction inlet 231, and then the sealing member 232 is pushed open inwards, such that the suction inlet is in an open state. When the vacuum cleaner is turned off, as the negative pressure disappears, the sealing member 232 is not pushed open by the gas flowing from the suction inlet 231. Therefore, the suction inlet 231 is in a sealed state, so as to maintain the dirt in the dust chamber 230.

Furthermore, in order to strengthen sucking away the dirt and other impurities attached to the floor, the carpet, the wall, or the furniture, a cleaning brush 510 is installed at the suction inlet 231 of the vacuum cleaner. The cleaning brush 510 may remove the dirt for facilitating sucking the dirt by the vacuum cleaner 600.

The blocking member 300 has a frame 310 and a filter screen 320, in which the frame 310 is mesh shaped, such that the filter screen 320 can be attached to the frame 310 and the filter screen 320 presents a mesh shaped filtering area. When the gas flows through the filtering area of the filter screen, the filter screen 320 filters the dirt in the gas.

It should be noted that, a barrier piece 330 is disposed at the blocking member 300 opposite to the suction inlet 231. When flowing through the filter screen 320, the gas is blocked by the barrier piece 330 and a flow velocity becomes slow, so as to form a slow flow area 250 between the barrier piece 330 and the suction inlet 231. The ambience of the filter screen 320 is not blocked by the barrier piece 330, such that the gas maintains a normal flow velocity. Therefore, the gas passes through the filter screen 320 from ambient areas of the barrier piece 330, so as to form distributaries. Therefore, the dirt is not attached to the filter screen 320 at the suction inlet 231 in a concentrated manner, but is attached to other areas of the filter screen 320 in a dispersed manner or slides into the dust chamber 230 along an ambient inner wall. In this way, through the barrier piece 330, the dirt is not accumulated at the suction inlet 231, and the spaces except for the suction inlet 231 in the dust chamber 230 are effectively used.

Furthermore, the air-extracting device 400 is configured on the dust collection container 100, so as to form a power source of the vacuum cleaner 600. The air-extracting device 400 has an air-extracting chamber 410 and a power element 420. The power element 420 is configured in the air-extracting chamber 410, such that the air-extracting chamber 410 has an air-extracting opening 411 corresponding to the exhaust opening 241, and then the pumped gas is exhausted out of the vacuum cleaner 600 through a gas outlet 412 corresponding to an external space of the vacuum cleaner 600.

Figure 2:
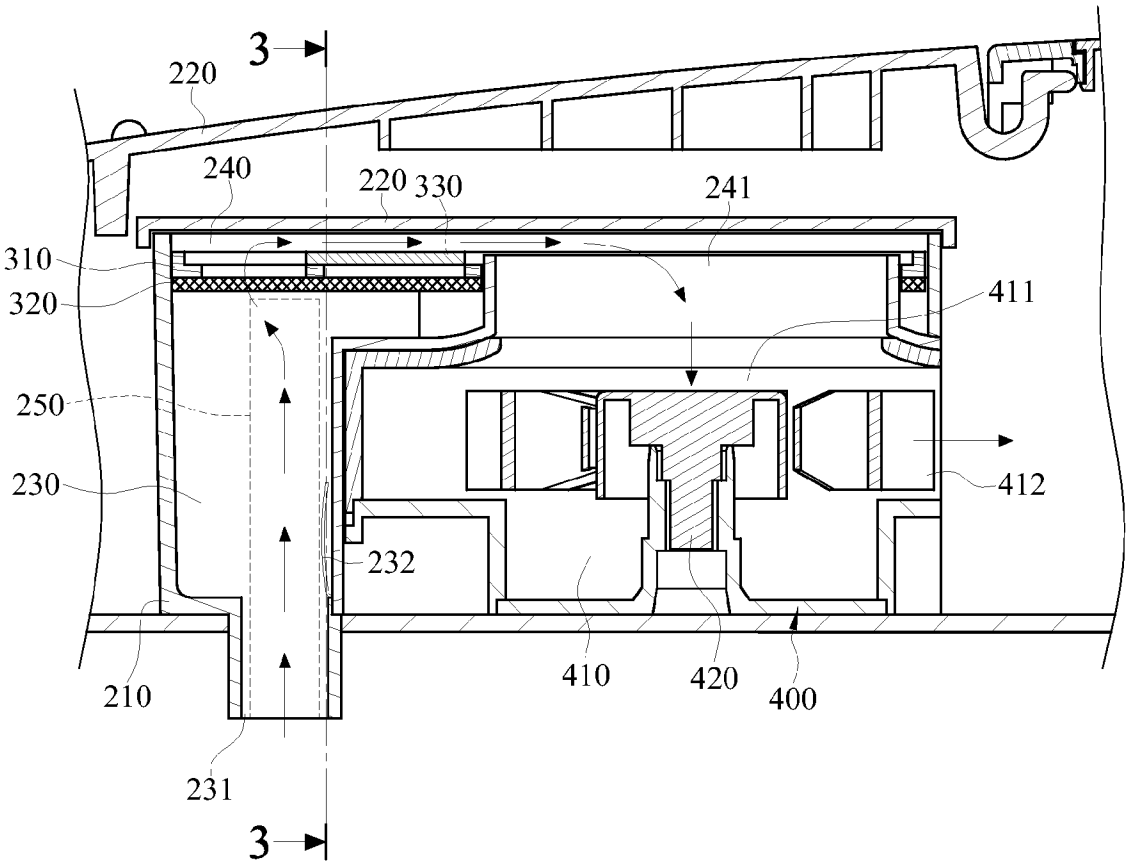
FIG. 2 is a schematic cross-sectional view of a flow channel of a vacuum cleaner according to an embodiment of the present invention.
Figure 3:
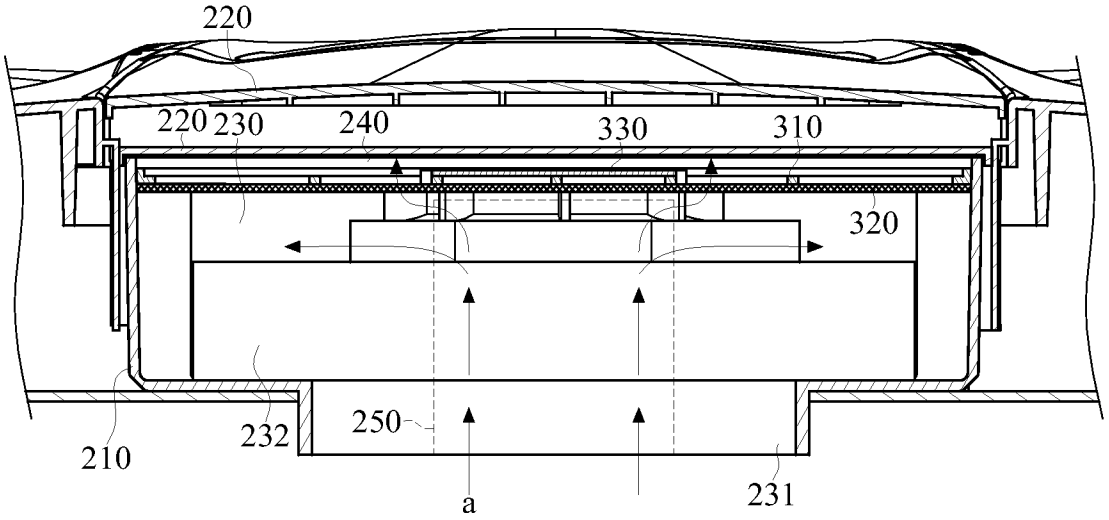
FIG. 3 is a schematic cross-sectional view of a vacuum cleaner and a schematic view of a gas flow path according to an embodiment of the present invention.

Referring to FIGS. 2 and 3, the barrier piece 330 is specially illustrated in the following. FIG. 2 is a schematic cross-sectional view of a flow channel of the vacuum cleaner 600, and FIG. 3 is a schematic cross-sectional view of the vacuum cleaner 600 and a schematic view of a gas flow path.

When the barrier piece 330 is disposed on a frame 310, the gas meets an obstruction after entering from a suction inlet 231, therefore, the gas flow path passes by the barrier piece 330 to form a filtering area (such as path a) leading to ambience of the barrier piece 330, such that the gas stores the dirt to the spaces except for the suction inlet 231 in the dust chamber 230 through the path a. As the dirt is accumulated at the areas except for the suction inlet 231, the suction inlet 231 is not blocked by the dirt. It should be noted that as the barrier piece 330 is configured at the suction inlet 231 in the vacuum cleaner 600, the flow velocity of the gas becomes slow as the gas meets obstruction when passing through the slow flow area 250. However, the gas looks for another path with a faster flow velocity, so the gas flows to areas (such as path a) except for the suction inlet 231, and the dirt is guided to the areas except for the suction inlet 231, and directly falls into the areas except for the suction inlet 231. Therefore, the dirt is not stored at the suction inlet 231, and other spaces of the dust chamber 230 may be effectively used to store the dust.

Furthermore, when the dust collection container 100 matches various vacuum cleaners 600, as other spaces of the dust chamber 230 may be effectively used to store the dust, the operation time of the vacuum cleaner 600 can be prolonged.

It should be noted that, in this embodiment, the vacuum cleaner 600 refers to a robot vacuum cleaner having an automatic cleaning function, therefore, cleaning times of the dust collection container 100 are reduced, and a working efficiency of the robot vacuum cleaner is relatively increased. Moreover, when no one cleans the dust collection container 100, the operation time of the robot vacuum cleaner may also be prolonged.

Figure 4:
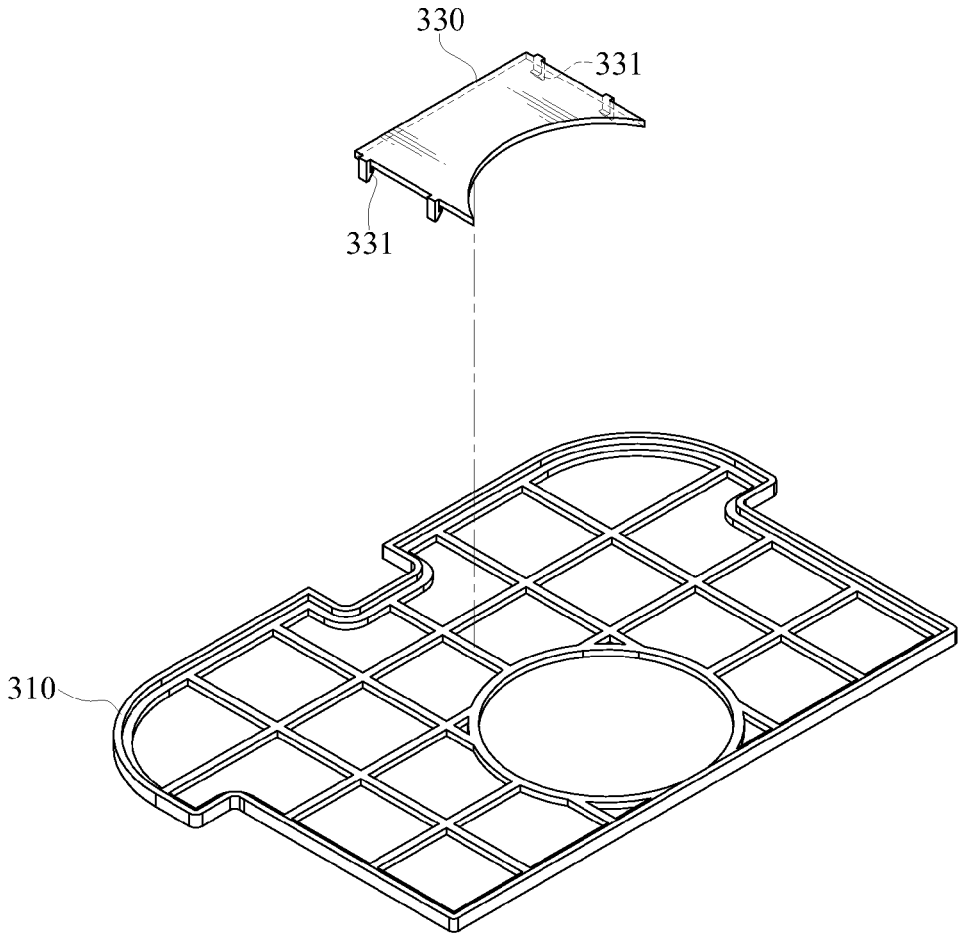
FIG. 4 is a schematic structural view of a barrier piece according to another embodiment of the present invention.

Furthermore, referring to FIG. 4, it is a schematic structural view of the barrier piece 330 according to another embodiment of the present invention is shown. In order to enable the barrier piece 330 configured in the vacuum cleaner to match designs of various suction inlets 231 in various vacuum cleaners 600, the barrier piece 330 may have different shapes according to the shapes of various suction inlets 231 in various vacuum cleaners 600. Moreover, in order to not replace the entire block member 300 but only to replace the barrier piece 330 when the dust collection container 100 matches the different vacuum cleaners 600, the barrier piece 330 further comprises a plurality of hook portions 331 which hooks the barrier piece 330 on a frame 310. In other words, the barrier pieces 330 with various shapes are selected to be configured on the frame 310 according to the shapes of various suction inlets 231.

Figure 5A:
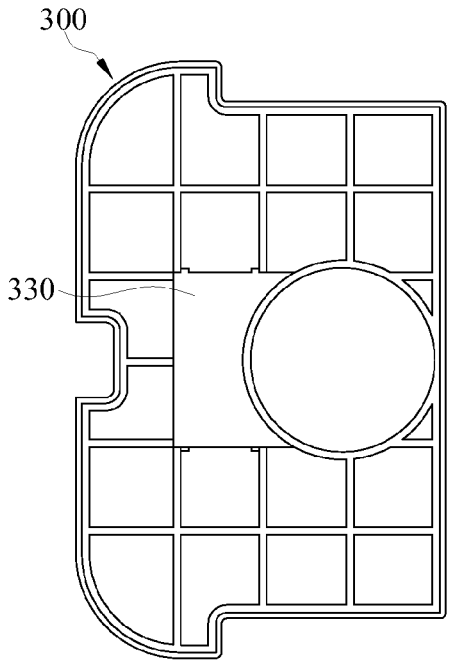
FIG. 5A is a schematic view of a shape of a barrier piece according to another embodiment of the present invention.
Figure 5B:
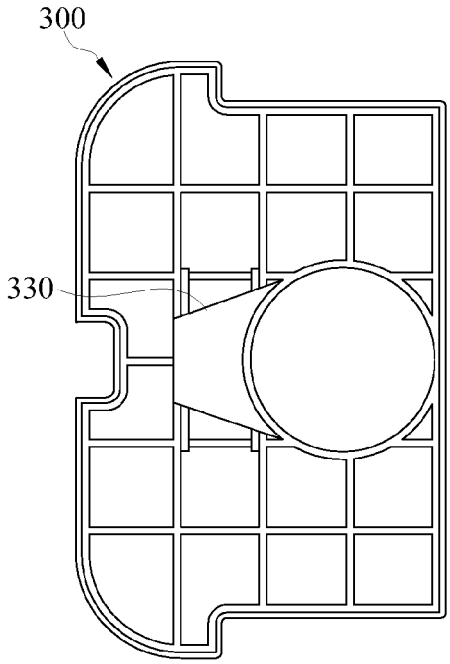
FIG. 5B is a schematic view of another shape of the barrier piece of FIG. 5A.
Figure 5C:
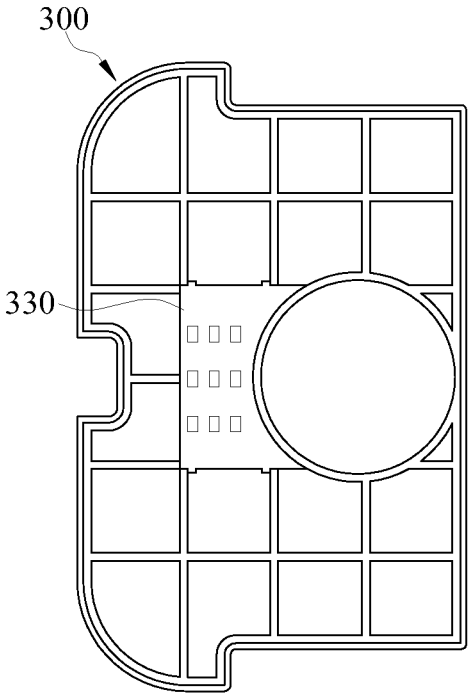
FIG. 5C is a schematic view of still another shape of the barrier piece of FIG. 5A.

Referring to FIGS. 5A to 5C, FIG. 5A is a schematic view of a shape of the barrier piece 330 according to another embodiment of the present invention, FIG. 5B is a schematic view of another shape of the barrier piece 330 of FIG. 5A, and FIG. 5C is a schematic view of still another shape of the barrier piece 330 of FIG. 5A. In FIG. 5B, in order to enable the gas to be smoother when passing through the barrier piece 330, the shape of the barrier piece 330 may be designed to be a streamline shape. In FIG. 5C, in order to enable the vacuum cleaner 600 to have a stronger suction than that of the original design when the gas passes through the barrier piece 330, a plurality of openings is opened on the barrier piece 330. The present invention is not limited to the shapes shown from FIGS. 5A to 5C, and persons skilled in the art may design the shape of the barrier piece 330 corresponding to the shape of the suction inlet 231 according to practical requirements.

In the dust collection container 100 and the vacuum cleaner 600 applying the same according to the present invention, the barrier piece 330 is configured on the frame 310 at the suction inlet 231, so as to form the slow flow area 250 between the barrier piece 330 and the suction inlet 231, thereby reducing the probability that the dirt is attached to the filter screen 320, and more effectively guiding the dirt to the spaces except for the suction inlet 231 in the dust chamber 230 to avoid the dirt from blocking the suction inlet 231. When the dust collection container 100 is applied to the vacuum cleaner 600, the operation time of the vacuum cleaner 600 may be prolonged.

Furthermore, the barrier piece 330 has the hook portions 331, such that when the shape of the suction inlet 231 of the vacuum cleaner 600 is changed, the barrier piece 330 is changed corresponding to the shapes of various suction inlets 231, and the entire blocking member 300 needs not to be changed. The manufacturers only need to produce the barrier pieces 330 satisfying the shapes of various suction inlets 231. In order to match the shape of the new suction inlet, only the new barrier piece 330 is snapped with the blocking member 300, so as to reduce a cost of producing the separation part 300.

What is claimed is:

1. A dust collection container, capable of being installed in a vacuum cleaner, comprising a case body and a blocking member, wherein the blocking member is disposed in the case body to separate the case body into a dust chamber and a diversion chamber, a suction inlet corresponding to the dust chamber and an exhaust opening corresponding to the diversion chamber are disposed in the case body, the blocking member further comprises a frame and a filter screen disposed on the frame, a barrier piece is disposed on the filter screen corresponding to the suction inlet, the barrier piece and the filter screen are two individual parts, and a length of the barrier piece is smaller than a length of the filter screen.

2. The dust collection container according to claim 1, wherein the case body further comprises a shell body and a lid body.

3. The dust collection container according to claim 1, wherein the barrier piece further comprises a plurality of hook portions, so as to enable the barrier piece to be disassembled and separated from the blocking member.

4. The dust collection container according to claim 1, wherein the suction inlet further comprises a sealing member.

5. A vacuum cleaner, comprising:

a dust collection container, comprising a case body and a blocking member, wherein the blocking member is disposed in the case body to separate the case body into a dust chamber and a diversion chamber, a suction inlet corresponding to the dust chamber and an exhaust opening corresponding to the diversion chamber are disposed in the case body, the blocking member further comprises a frame and a filter screen disposed on the frame, a barrier piece is disposed on the filter screen corresponding to the suction inlet, the barrier piece and the filter screen are two individual parts, and a length of the barrier piece is smaller than a length of the filter screen; and an air-extracting device, having an air-extracting chamber and a power element, wherein the air-extracting chamber is disposed with an air-extracting opening corresponding to the exhaust opening and a gas outlet corresponding to an outside part of the vacuum cleaner, the power element is disposed in the air-extracting chamber, and enables a gas to be sucked from the suction inlet and exhausted from the gas outlet during operation.

6. The vacuum cleaner according to claim 5, wherein the case body further comprises a shell body and a lid body.

7. The vacuum cleaner according to claim 5, wherein the barrier piece further comprises a plurality of hook portions, so as to enable the barrier piece to be disassembled and separated from the blocking member.

8. The vacuum cleaner according to claim 5, further comprising a plurality of wheels, disposed at a bottom of the shell body.

9. The vacuum cleaner according to claim 5, further comprising a cleaning brush, installed at the suction inlet.

10. The vacuum cleaner according to claim 5, wherein the suction inlet further comprises a sealing member.

* * * * *